US011319181B2

(12) United States Patent
Furumido et al.

(10) Patent No.: US 11,319,181 B2
(45) Date of Patent: May 3, 2022

(54) DISCHARGING DEVICE, PROCESSING APPARATUS, AND RECORDING SYSTEM

(71) Applicant: SEIKO EPSON CORPORATION, Tokyo (JP)

(72) Inventors: Tsuyoshi Furumido, Shiojiri (JP); Hirohisa Adachi, Matsukawa-Machi (JP); Toshikazu Kotaka, Matsumoto (JP); Tetsuji Takeishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/070,382

(22) Filed: Oct. 14, 2020

(65) Prior Publication Data

US 2021/0114835 A1 Apr. 22, 2021

(30) Foreign Application Priority Data

Oct. 17, 2019 (JP) ..... JP2019-190024

(51) Int. Cl.
*B65H 29/34* (2006.01)
*B65H 31/30* (2006.01)

(52) U.S. Cl.
CPC ..... *B65H 31/3009* (2013.01); *B65H 29/34* (2013.01); *B65H 2301/42261* (2013.01)

(58) Field of Classification Search
None
See application file for complete search history.

(56) References Cited

U.S. PATENT DOCUMENTS 6,494,449 B2 * 12/2002 Tamura ..... B65H 29/22 270/58.13
7,758,033 B2 * 7/2010 Terao ..... B65H 31/3081 270/58.02
7,883,081 B2 * 2/2011 Iguchi ..... B65H 31/02 270/58.17
8,328,176 B2 * 12/2012 Shimamura ..... B65H 31/3072 270/58.13
10,737,897 B2 * 8/2020 Kondo ..... B65H 29/38
10,961,073 B2 * 3/2021 Rasmussen ..... B65H 29/52
2007/0145660 A1 6/2007 Terao et al.
(Continued)

FOREIGN PATENT DOCUMENTS

JP 2007-169047 A 7/2005
JP 2013-220915 A 10/2013
JP 2014-019569 A 2/2014

*Primary Examiner* — Leslie A Nicholson, III
(74) *Attorney, Agent, or Firm* — Workman Nydegger

(57) ABSTRACT

A discharging device includes: a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, each of the pair of medium supporting portions is configured to move in the width direction, the pair of medium supporting portions are configured to be arranged, after the medium is dropped onto the stacking portion, at positions at which a distance in the width direction becomes a predetermined distance, and the predetermined distance varies in accordance with a width of the medium stacked on the stacking portion.

18 Claims, 6 Drawing Sheets

(56) References Cited

U.S. PATENT DOCUMENTS

| | | | | |
|---|---|---|---|---|
| 2012/0063830 | A1* | 3/2012 | Song | B65H 31/20<br>399/407 |
| 2019/0225446 | A1* | 7/2019 | Rasmussen | B65H 29/10 |
| 2020/0207567 | A1* | 7/2020 | Uchibori | B65H 31/3081 |

* cited by examiner

DISCHARGING DEVICE, PROCESSING APPARATUS, AND RECORDING SYSTEM

The present application is based on, and claims priority from JP Application Serial Number 2019-190024, filed Oct. 17, 2019, the disclosure of which is hereby incorporated by reference herein in its entirety.

BACKGROUND

1. Technical Field

The present disclosure relates to a discharging device that includes a pair of medium supporting portions which support a transported medium and a stacking portion on which the medium dropped from the pair of medium supporting portions is stacked, a processing apparatus that includes the discharging device, and a recording system that includes the processing apparatus.

2. Related Art

In the related art, there exists a discharging device that has a structure in which a stacking portion is provided vertically below medium supporting portions, and a medium that drops from the medium supporting portions is received by the stacking portion and stacked thereon (e.g., JP-A-2013-220915).

In the aforementioned discharging device in the related art, the pair of medium supporting portions is positioned just above the stacking portion. Therefore, there is a problem that, when a user removes a medium stacked on the stacking portion, the medium supporting portions positioned just above the stacking portion are obstructive and it is therefore difficult to remove the medium.

However, JP-A-2013-220915 does not give a description by taking the problem into consideration, and no suggestion therefor is made.

SUMMARY

A discharging device of the present disclosure by which the aforementioned problem is solved includes: a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, in which each of the pair of medium supporting portions are configured to move in the width direction, the pair of medium supporting portions are configured to be arranged, after the medium is dropped onto the stacking portion, at positions at which a distance in the width direction becomes a predetermined distance, and the predetermined distance varies in accordance with a width of the medium stacked on the stacking portion.

DESCRIPTION OF EXEMPLARY EMBODIMENTS

Figure 1:
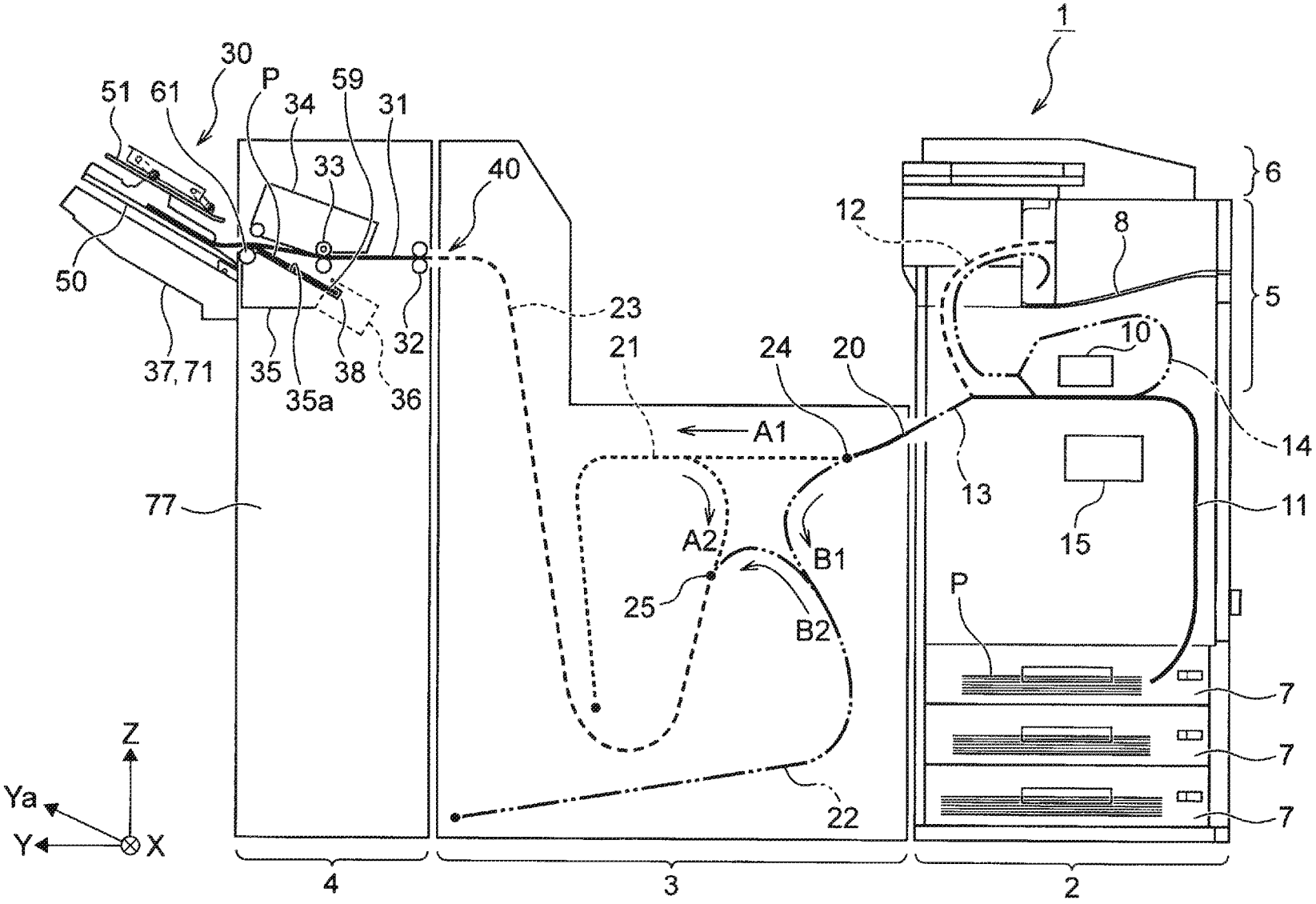
FIG. 1 is a schematic view illustrating a recording system of Embodiment 1.

First, the disclosure will be schematically described.

A discharging device according to a first aspect of the disclosure by which the aforementioned problem is solved includes: a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, in which each of the pair of medium supporting portions is configured to move in the width direction, the pair of medium supporting portions are configured to be arranged, after the medium is dropped onto the stacking portion, at positions at which a distance in the width direction becomes a predetermined distance, and the predetermined distance varies in accordance with a width of the medium stacked on the stacking portion.

Here, "configured to be arranged" denotes that the pair of medium supporting portions may be arranged at the positions, at which the distance becomes the predetermined distance, every time the medium is dropped onto the stacking portion or after a predetermined number of media are dropped, or a user may be able to set a timing at which the pair of medium supporting portions are arranged at the positions.

According to the present aspect, each of the pair of medium supporting portions is configured to move in the width direction, the pair of medium supporting portions are configured to be arranged, after the medium is dropped onto the stacking portion, at the positions at which the distance in the width direction becomes the predetermined distance, and the predetermined distance varies in accordance with the width of the medium stacked on the stacking portion. Thereby, in accordance with the width of the medium to be stacked on the stacking portion, it is possible to move the pair of medium supporting portions to the positions which facilitate removing the medium.

In the discharging device of a second aspect of the disclosure, according to the first aspect, when one job is executed for the medium in a stage before the medium is transported to the pair of medium supporting portions, after one set of medium, which corresponds to the one job, drops onto the stacking portion from the pair of medium supporting portions, the pair of medium supporting portions are arranged at the positions at which the distance becomes the predetermined distance.

Here, for example, when recording is executed by a recording apparatus of an ink jet type or the like in the preceding stage, the "one job" denotes an instruction related to a recording mode that includes the number of sheets or the number of copies which is set in advance. When the recording based on the instruction is executed, a group of the one set of the medium, which corresponds to the one job, is generated. Moreover, when, for example, binding processing using a staple or the like is executed in the preceding stage, the "one job" denotes an instruction related to a binding mode of the number of media, a position of a staple, or the like, which is set in advance.

Regarding the group of the medium, there may be a job in which one medium constitutes the group, or there may be a job in which a plurality of sheets constitute the group. Furthermore, one set constituted by a plurality of media may be the group, or a plurality of sets may be the group.

According to the present aspect, after one set of medium, which corresponds to the one job, drops onto the stacking portion from the pair of medium supporting portions, the pair of medium supporting portions are arranged at the positions at which the distance becomes the predetermined distance. Thereby, it is possible to move the pair of medium supporting portions to the positions which facilitate removal of the medium, in accordance with actual circumstances that the timing of removing the medium is set for each group in multiple cases.

In the discharging device of a third aspect of the disclosure, according to the first aspect or the second aspect, a configuration is provided so that timing at which the pair of medium supporting portions are arranged at the positions at which the distance becomes the predetermined distance is adjusted.

According to the present aspect, the configuration is provided so that the timing at which the pair of medium supporting portions are arranged at the positions at which the distance becomes the predetermined distance is able to be adjusted. Thereby, it is possible to move the pair of medium supporting portions to the positions, at which the distance becomes the predetermined distance, only when the medium stacked on the stacking portion is removed, and accordingly, it is possible to suppress unnecessary movement from being performed.

In the discharging device of a fourth aspect of the disclosure, according to any aspect from the first aspect to the third aspect, the stacking portion is configured to be raised/lowered by a moving mechanism and be stopped between an upper limit position and a lower limit position when being raised/lowered.

According to the present aspect, since the stacking portion is configured to be stopped by the moving mechanism between the upper limit position and the lower limit position when being raised/lowered, when the stacking portion is lowered, it is possible to achieve a state where the medium is easily removed.

In the discharging device of a fifth aspect of the disclosure, according to the fourth aspect, the stacking portion is configured to move to a removal position that is lower than a receiving position at which the medium that drops from the pair of medium supporting portions is received.

Here, the "receiving position at which the medium that drops from the pair of medium supporting portions is received" denotes the receiving position in a state where the medium is stacked on the stacking portion.

Moreover, the movement of the stacking portion to the removal position is not performed on the assumption that the pair of medium supporting portions are arranged at the positions at which the distance becomes the predetermined distance. That is, the movement of the stacking portion to the removal position may be executed in a state where the pair of medium supporting portions is not arranged at the positions at which the distance becomes the predetermined distance.

According to the present aspect, the stacking portion is configured to move to the removal position that is lower than the receiving position at which the medium that drops from the pair of medium supporting portions is received. Thereby, by moving the stacking portion to the removal position, it is possible to achieve the state where the medium is easily removed.

In the discharging device of a sixth aspect of the disclosure, according to any aspect from the first aspect to the fifth aspect, when the width of the medium stacked on the stacking portion is equal to or more than a predetermined width, the pair of medium supporting portions are arranged at positions at which a distance between portions which are farthest in the width direction becomes the predetermined distance which is less than the width of the medium stacked on the stacking portion.

According to the present aspect, when the width of the medium is wide, the pair of medium supporting portions moves to positions at which open spaces are provided in side portions of the medium, that is, to an inner side of the width of the medium. Thereby, it is possible to achieve the state where the medium is easily removed in accordance with the width of the medium.

In the discharging device of a seventh aspect of the disclosure, according to any aspect from the first aspect to the fifth aspect, when the width of the medium stacked on the stacking portion is less than a predetermined width, the pair of medium supporting portions are arranged at positions at which a distance between portions which are closest in the width direction becomes the predetermined distance which is greater than the width of the medium stacked on the stacking portion.

According to the present aspect, when the width of the medium is narrow, the pair of medium supporting portions moves to positions at which open spaces are provided in the side portions of the medium, that is, separate positions outward from the sides of the medium. Thereby, it is possible to achieve the state where the medium is easily removed in accordance with the width of the medium.

A processing apparatus of an eighth aspect of the disclosure includes: a processing portion that performs processing of a medium; and the discharging device according to any aspect from the first aspect to the seventh aspect, which receives, by using the medium supporting portions, the medium that passed through the processing portion.

According to the present aspect, in the processing apparatus, it is possible to obtain an effect similar to those of the first aspect to the seventh aspect.

A recording system of a ninth aspect of the disclosure includes: a recording apparatus including a recording portion that performs recording on a medium and a discharging portion that discharges the medium on which the recording was performed by the recording portion; and the processing apparatus of the eighth aspect, including a medium leading portion that leads the medium discharged from the discharging portion and performing, by the processing portion, processing of the medium led from the medium leading portion.

According to the present aspect, in the recording system including the recording apparatus, it is possible to obtain an effect similar to that of the eighth aspect.

Embodiment 1

Hereinafter, Embodiment 1 of the disclosure will be specifically described with reference to FIGS. 1 to 4B.

An X-Y-Z coordinate system illustrated in each figure is an orthogonal coordinate system, and an X-axis direction corresponds to a width direction of a medium P and is also to a depth direction of each device or each apparatus. A Y-axis direction corresponds to a length direction of the medium P when the medium P is horizontally transported, and is also to a width direction of each device or each apparatus. A Z-axis direction corresponds to a thickness or stacking height direction when the medium P is horizontally mounted, and also indicates a vertical direction or a height direction of each device or each apparatus.

Moreover, a Ya-axis direction indicates a transporting direction or a discharging direction in a processing apparatus or a discharging device of the present embodiment. Further, +Ya indicates a downstream when the medium P is transported or discharged and −Ya indicates an upstream which is opposite to the downstream. In the present embodiment, the Ya-axis direction is set as a direction of an upward slope, a+Ya side of which is higher in the Z-axis direction to some extent, compared to the horizontal Y-axis direction.

Overall Configuration of Recording System

First, an outline of an overall configuration of a recording system that includes the processing apparatus having the discharging device according to the present embodiment will be described with reference to FIGS. 1 to 3.

A recording system 1 of the present embodiment includes a recording apparatus 2 that has a recording portion 10 which performs recording on the medium P and a second discharging path 13 that serves as a discharging portion discharging the medium P on which recording has been performed in the recording portion 10.

Furthermore, the recording system 1 includes a processing apparatus 4 including a medium leading portion 40 which leads the medium P discharged from the second discharging path 13 serving as the discharging portion, a processing portion 36 which performs processing for the medium P led from the medium leading portion 40, a pair of medium supporting portions 50L and 50R (FIG. 3) which are provided so as to face each other in the width direction X intersecting the transporting direction Ya in which the medium P that has been passed through the processing portion 36 is transported and each of which has a supporting surface 50*a* supporting the medium P and supports, by the supporting surface 50*a*, the medium P to be transported, a stacking portion 37 which is provided in a lower side of the pair of medium supporting portions 50L and 50R in the vertical direction Z, on which the medium P that drops from the pair of medium supporting portions 50L and 50R is stacked, and which is able to be raised/lowered, and a standing wall 140 (FIG. 3) which is in contact with a rear end 59 (FIG. 2) in the transporting direction Ya of the medium P supported by the pair of medium supporting portions 50L and 50R and thereby adjusts the medium P. The supporting surface 50*a* is inclined upward toward a downstream+Ya side of the transporting direction Ya.

Specifically, in the present embodiment, the recording system 1 is configured as illustrated in FIG. 1, and the recording apparatus 2, an intermediate apparatus 3, and the processing apparatus 4 that includes a discharging device 30 of the present embodiment, which will be described later, are provided in order from a right side to a left side of FIG. 1.

Then, the recording apparatus 2, the intermediate apparatus 3, and the processing apparatus 4 are coupled to each other and configured so that the medium P which has been supplied by the recording apparatus 2 and on which recording has been executed is continuously transported and discharged while being led into the processing apparatus 4 via the intermediate apparatus 3 and delivered to the stacking portion 37 in the end.

Hereinafter, in order of the recording apparatus 2, the intermediate apparatus 3, and the processing apparatus 4, schematic configurations thereof will be described.

Outline of Recording Apparatus

The recording apparatus 2 is configured as a multifunction peripheral including a printer portion 5 which includes the recording head (recording portion) 10 that executes recording by ejecting ink, which is an example of liquid, on a recording sheet, which is an example of the medium P, and a scanner portion 6 which reads an image recorded on an original. In the present embodiment, the printer portion 5 is configured as a so-called ink jet printer, and a line head that executes recording in the width direction X of the medium P at once is adopted as an example of the recording head 10.

Moreover, in a lower portion of an apparatus main body of the recording apparatus 2, medium accommodating cassettes 7 are provided over a plurality of tiers, and, for example, a plurality of sheets of media P having different sizes are sorted in accordance with the sizes and separately accommodated in the medium accommodating cassettes 7.

The medium P accommodated in a medium accommodating cassette 7 of each of the tiers passes through a feeding path 11, which is indicated by a solid line in the recording apparatus 2 of FIG. 1, and is sent to a recording region of the printer portion 5, in which the recording head 10 exists, and a desired recording operation is executed thereon. The medium P on which recording has been executed by the recording head 10 is supplied to either a first discharging path 12 through which the medium P is discharged toward, for example, a discharging tray 8 provided above the recording head 10 or the second discharging path 13 through which the medium P is discharged toward the processing apparatus 4 of the present embodiment via the intermediate apparatus 3 described next.

Note that, in FIG. 1, the first discharging path 12 is indicated by a broken line and the second discharging path 13 is indicated by a one-dot chain line.

Moreover, an inverting path 14 indicated by a two-dot chain line is also provided in the printer portion 5 of the recording apparatus 2, and double-side recording that recording on a front surface of the medium P is executed and thereafter the medium P is inverted and recording on a rear surface is successively executed is able to be executed.

Note that, although illustration will be omitted, in each of the feeding path 11, the first discharging path 12, the second discharging path 13, and the inverting path 14, one or more transporting roller pairs that apply transporting force to the medium P and a guide roller or a guide member that guides transportation of the medium P are arranged as appropriate.

Additionally, the recording apparatus 2 is provided with an operation panel (not illustrated) which is used, for example, when various types of information related to transportation or recording of the medium P is input and a control portion 15 which controls various operations related to the transportation or the recording of the medium P based on the input various types of information.

Note that, a structure in which the operation panel and the control portion 15 are provided in each of the recording apparatus 2, the intermediate apparatus 3, and the processing apparatus 4 may be provided, or a structure in which the operation panel and the control portion 15 are provided in only the recording apparatus 2 but control all of the apparatuses may be provided.

Outline of Intermediate Apparatus

The intermediate apparatus 3 is an apparatus that receives, from the recording apparatus 2, the medium P which is discharged through the second discharging path 13 after execution of recording and that delivers the medium P to the processing apparatus 4.

The intermediate apparatus 3 is provided with an intermediate receiving path 20 through which the medium P that is discharged through the second discharging path 13 of the recording apparatus 2 after execution of recording is received in an apparatus main body of the intermediate apparatus 3 and which is indicated by a solid line in FIG. 1.

Furthermore, a branching portion 24 is provided at an end of the intermediate receiving path 20, and two transporting paths through which the medium P is transported are provided with the branching portion 24 as a starting point. A first transporting path of the two transporting paths is a transporting path which reaches to an intermediate discharging path 23 from the intermediate receiving path 20 via a first switchback path 21.

Note that, the first switchback path 21 is a path through which the medium P is received in a direction of an arrow A1 and the medium P is then switched back in a direction of an arrow A2 and caused to reach to the intermediate discharging path 23. A second switchback path 22 is a path through which the medium P is received in a direction of an arrow B1 and the medium P is then switched back in a direction of an arrow B2 and caused to reach to the intermediate discharging path 23.

Accordingly, a configuration is provided so that a merging portion 25 is provided at ends of the first switchback path 21 and the second switchback path 22 and both the medium P sent to the first switchback path 21 and the medium P sent to the second switchback path 22 are able to be guided to the common intermediate discharging path 23 and the media P are able to be delivered to the processing apparatus 4 that has the discharging device 30 described later.

Note that, although illustration will be omitted, in each of the intermediate receiving path 20, the first switchback path 21, the second switchback path 22, and the intermediate discharging path 23, one or more transporting roller pairs that apply transporting force to the medium P and a guide roller or a guide member that guides transportation of the medium P are arranged as appropriate.

Moreover, when recording is successively executed on a plurality of media P, it is possible to send the medium P, which has been received into the intermediate apparatus 3, alternately to the transporting path that passes through the first switchback path 21 and the transporting path that passes through the second switchback path 22. Incidentally, with such a configuration, it is possible to enhance throughput of transportation of the medium P in the intermediate apparatus 3 and thereby achieve efficient intermediate transportation.

Note that, when the medium P on which recording has been executed by the recording apparatus 2 is sent to the processing apparatus 4 via the intermediate apparatus 3, it is possible to take long transporting time as compared with a case where the medium P is directly sent to the processing apparatus 4 from the recording apparatus 2, so that an effect of promoting drying of ink, which has been ejected to the front surface or the rear surface of the medium P and adheres thereto, before the medium P is transported to the processing apparatus 4 is able to be obtained.

Moreover, when the aforementioned promotion of drying of the ink or the like is not necessary, it is also possible to omit the intermediate apparatus 3 and provide the recording system 1 that includes only the recording apparatus 2 and the processing apparatus 4.

Outline of Processing Apparatus

The processing apparatus 4 is an apparatus that, for example, gathers a plurality of media P, on which recording has been executed by the recording apparatus 2 and drying of which has been promoted by the intermediate apparatus 3, to form a bundle, executes predetermined processing after adjustment, and sequentially discharges the bundle to the stacking portion 37 by the discharging device 30 to stack the bundle thereon.

Accordingly, the processing apparatus 4 is provided with a transporting element by which the medium P delivered from the intermediate apparatus 3 is guided into an apparatus main body of the processing apparatus 4 and transported to be adjusted and discharged, an adjusting element by which a plurality of transported media P are gathered to be formed into a bundle and are adjusted, a processing element by which predetermined processing such as staple processing is executed for the adjusted media P, and a discharging and stacking element by which the media P subjected to the processing are discharged and sequentially stacked.

In the present embodiment, the transporting element includes a transporting path 31, a first transporting roller pair 32, a second transporting roller pair 33, a medium transporting portion 34, and a medium mounting portion 35. Moreover, the adjusting element includes a rear end adjusting portion 38, and a paddle mechanism and a side end adjusting portion illustration of both of which is omitted. The processing element includes the processing portion 36 of, for example, staple processing, punching processing, folding processing, saddle stitching processing, or the like. The discharging and stacking element includes the discharging device 30, the medium supporting portions 50, the standing wall 140, and the stacking portion 37.

Further, in the present embodiment, a pressing element by which occurrence or the like of lateral curl that is caused by transportation and caused when a leading end 56 of the medium P becomes curved upward, longitudinal curl that is caused when side ends 57L and 57R of left and right of a leading end portion 53 of the medium P become curved upward, and swelling curl that is caused when a center portion of the medium P rises upward due to swell caused by ink is suppressed is provided. The pressing element includes a pressing portion 51 and the medium supporting portions 50.

Furthermore, in the medium leading portion 40 of the processing apparatus 4, the transporting path 31 that guides the medium P delivered to the processing apparatus 4 into the apparatus main body so that predetermined transportation is able to be executed is provided. Moreover, on the transporting path 31, two sets of transporting roller pairs of the first transporting roller pair 32 and the second transporting roller pair 33 that apply transporting force to the medium P led into the apparatus main body are provided as an example.

Specific Configuration of Processing Apparatus

As illustrated in FIGS. 1 to 4B, the processing apparatus 4 of the present embodiment is configured to include the processing portion 36 that performs predetermined processing of the medium P, the medium supporting portions 50 that are provided so as to face each other in the medium width direction X intersecting the transporting direction Ya in which the medium P which has passed through the processing portion 36 is transported, have supporting surfaces 50*a* which support the medium P, support parts of the medium P to be transported, which are parts outside a center in the width direction X, and are movable, that is, the pair of medium supporting portions 50L and 50R, and the stacking portion 37 which is provided on the lower side of the pair of medium supporting portions 50 in the vertical direction Z and on which the medium P dropped from the pair of medium supporting portions 50L and 50R is stacked.

Furthermore, as illustrated in FIG. 1, in the present embodiment, the medium mounting portion 35 that has a mounting surface 35*a* which is able to support a part on a rear end 59 side of the medium P transported from the intermediate apparatus 3 is provided at a position in the upstream−Ya of the transporting direction Ya in the medium supporting portions 50. Then, the medium transporting portion 34 that includes the paddle mechanism which assists an operation of the rear end adjusting portion 38 and illustration of which is omitted is provided above the medium mounting portion 35.

Specific Configuration of Discharging Device (FIGS. 2 to 4B)

The discharging device 30 of the present embodiment includes the pair of medium supporting portions 50L and 50R that are provided so as to face each other in the width direction X intersecting the transporting direction Ya in which the medium P is transported and that support, by the supporting surfaces 50*a*, the medium P that is transported, and the stacking portion 37 that is provided vertically below the pair of medium supporting portions 50L and 50R and on which the medium P that drops from the pair of medium supporting portions 50L and 50R is stacked. Each of the pair of medium supporting portions 50L and 50R is movable in the width direction X, and the pair of medium supporting portions 50L and 50R is arrangeable at a position at which a distance in the width direction X becomes a predetermined distance after the medium P is dropped onto the stacking portion 37.

Here, the predetermined distance varies in accordance with a width of the medium P stacked on the stacking portion 37. That is, the predetermined distance is set so that the pair of medium supporting portions 50L and 50R is moved to positions, which facilitate taking out the medium P from the stacking portion 37, in accordance with the width of the medium P stacked on the stacking portion 37.

In this case, the pair of medium supporting portions 50L and 50R may be arranged at the positions, at which the distance becomes the predetermined distance, every time the medium P is dropped onto the stacking portion 37 or after a predetermined number of media P are dropped, or a user may be able to set timing when the pair of medium supporting portions 50L and 50R is arranged at the positions.

Figure 2:
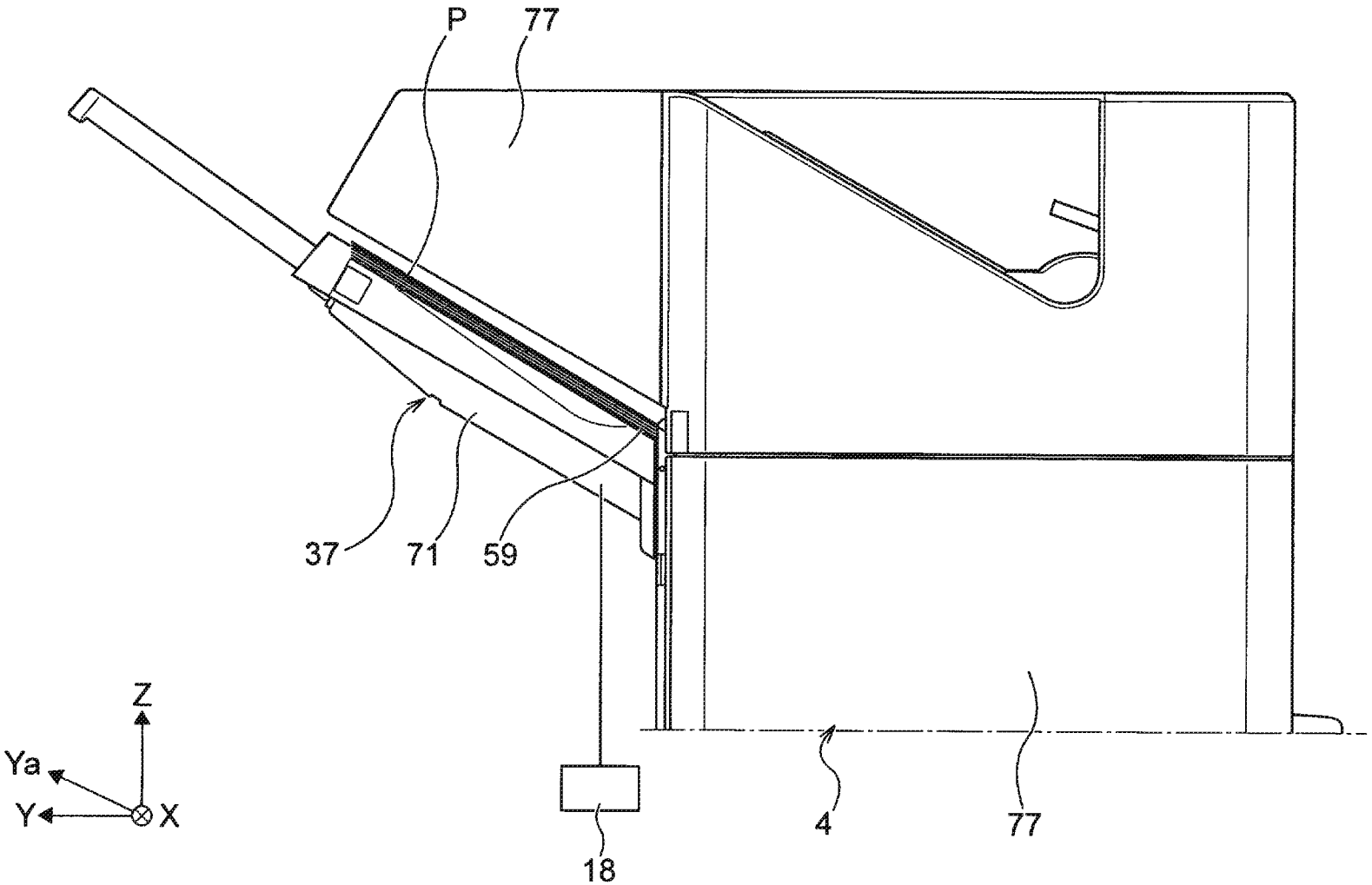
FIG. 2 is a front view illustrating a processing apparatus of Embodiment 1.
Figure 3:
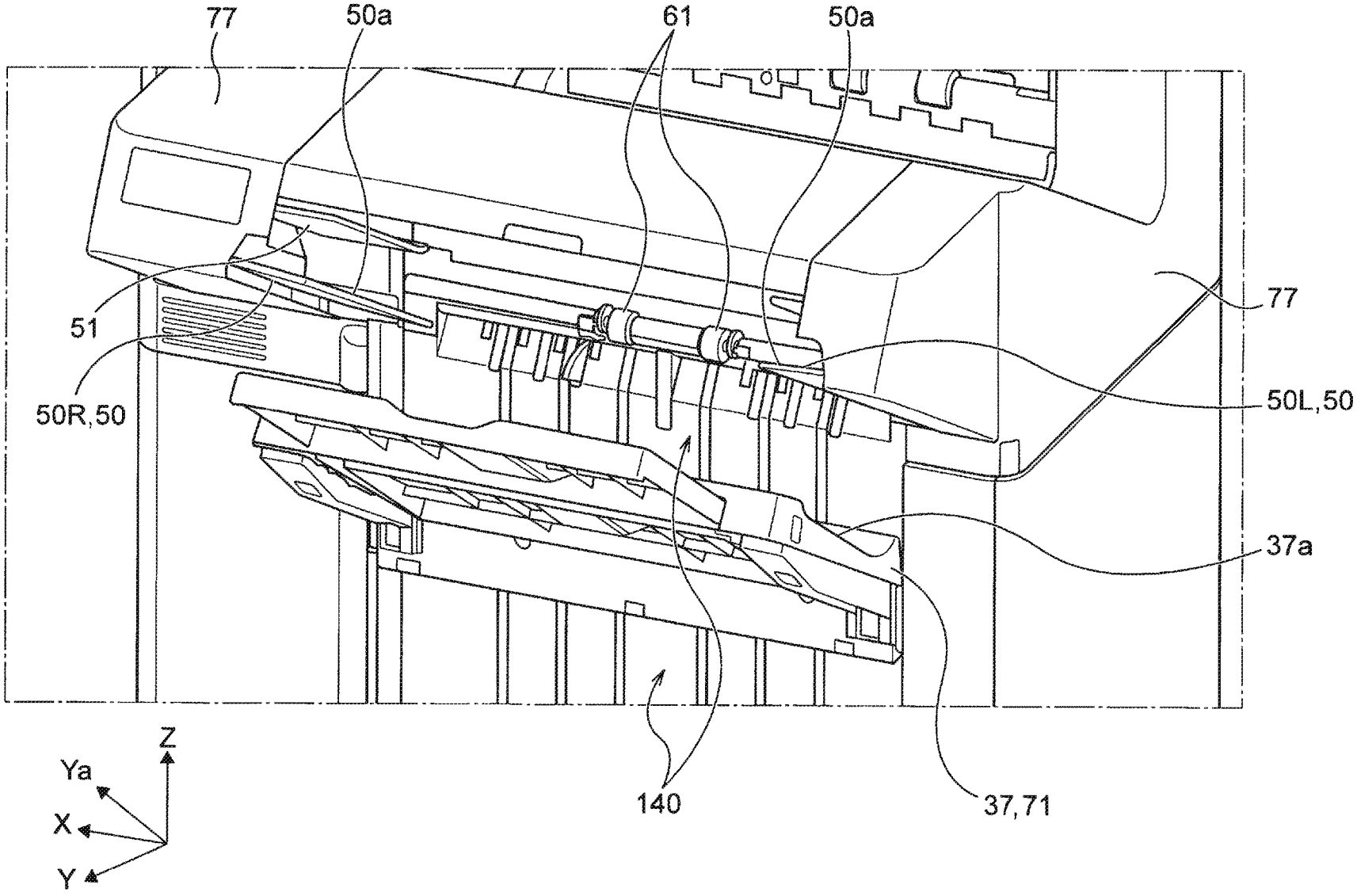
FIG. 3 is a perspective view illustrating the processing apparatus.

As illustrated in FIGS. 2 and 3, in the present embodiment, the pair of medium supporting portions 50L and 50R is surrounded by a housing 77 of the processing apparatus 4. Since the housing 77 is provided, depending on positions to which the pair of medium supporting portions 50L and 50R moves and at which the pair of medium supporting portions 50L and 50R stops, it is difficult to remove the medium P on the stacking portion 37 in some cases. Then, as described above, a configuration is provided so that the pair of medium supporting portions 50L and 50R is able to be moved to the positions, which facilitate taking out the medium P from the stacking portion 37, in accordance with the width of the medium P to be stacked on the stacking portion 37.

Figure 4A:
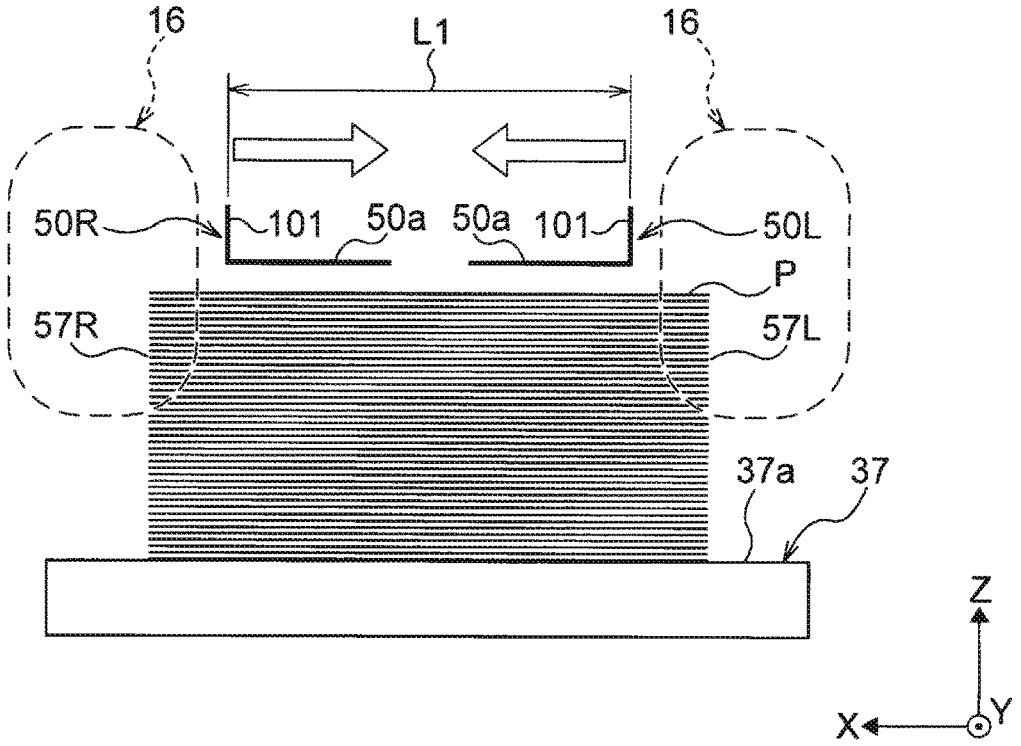
FIGS. 4A and 4B are views for explaining an operation of the processing apparatus.
Figure 4B:
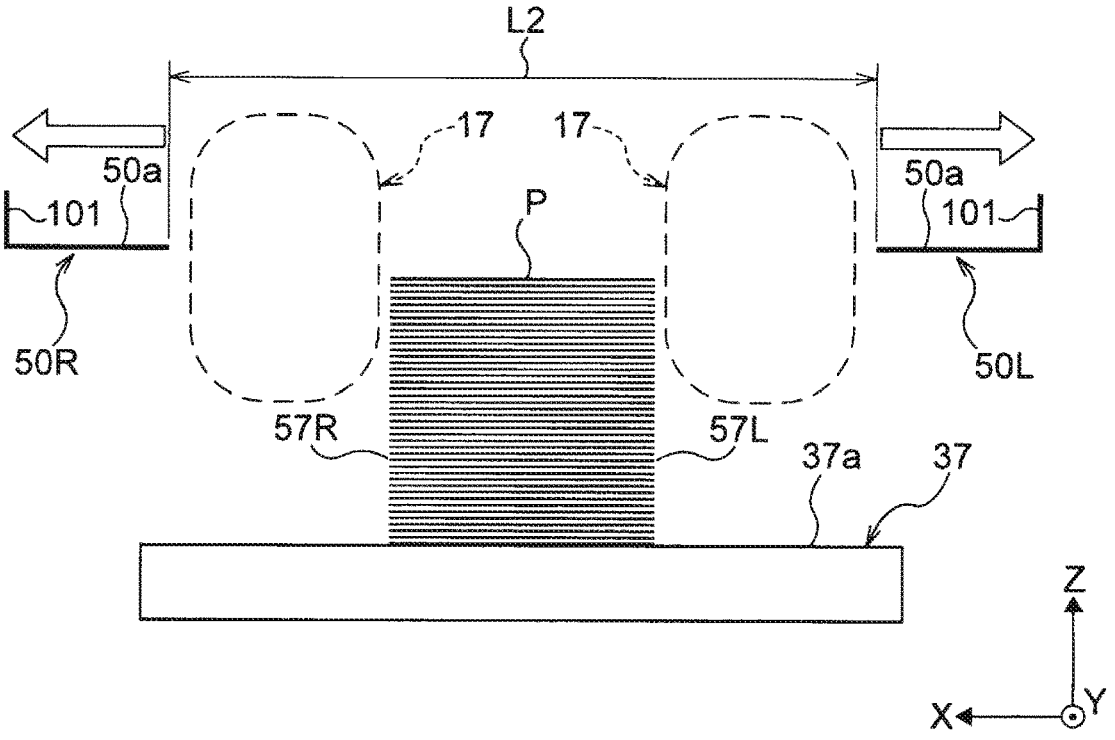

As illustrated in FIGS. 4A and 4B, each of the medium supporting portions 50 is a medium supporting member in which the supporting surface 50*a* and a side plate 101 an inner wall surface of which serves as a regulating surface when adjusting the side end 57L or 57R of the medium P in a state of being supported by the supporting surfaces 50*a* are integrally formed and a portional form of which is an L-shape.

As illustrated in FIGS. 1 and 3, the medium supporting portions 50 are provided in an inclined attitude of an upward inclination in which the downstream+Ya side which extends along the discharging direction Ya is higher.

As described above, the medium supporting portions 50 are arranged so as to be at right and left in the medium width direction X one by one and face each other, and are configured to be capable of shifting and moving by a predetermined stroke in the medium width direction X. When supporting the medium P, both of the pair of right and left medium supporting portions 50L and 50R shift in an approaching direction and support a lower surface in vicinities of the side ends 57L and 57R of the medium P.

A configuration is provided so that, when the support of the media P is canceled and a bundle of the media P is dropped onto a stacking surface 37*a* of the stacking portion 37 in the lower side, both of the pair of right and left medium supporting portions 50L and 50R shift and move in a separating direction so as to move out of a region where the media P exist.

The stacking portion 37 is configured to include a discharge tray 71 that receives the bundle of the media P, that has dropped to the lower side in the vertical direction Z when the support by the medium supporting portions 50 has been canceled, and is able to be raised/lowered. The stacking portion 37 raises/lowers the discharge tray 71 by a moving mechanism 18.

In the present embodiment, the discharge tray 71 is configured to be positioned at an initial position under the medium supporting portions 50 while keeping a constant distance between the stacking surface 37*a* and the medium supporting portions 50 at all times in a state where there is no medium P. In the housing 77 on a side of a base portion side of the discharge tray 71 in a state where the discharge tray 71 is positioned at the initial position, a medium height sensor illustration of which is omitted is provided. When the bundle of the media P is dropped onto the stacking surface 37*a* of the discharge tray 71, the sensor detects existence of the media P, and the moving mechanism 18 is driven so as to lower the discharge tray 71 downward in the vertical direction Z by an amount of a lamination height of the bundle of the media P, that has dropped. Thereby, a dropping distance when the bundle of the media P is dropped onto the stacking portion 37 from the medium supporting portions 50 is kept to be approximately constant. When the media P is removed from the stacking portion 37, the discharge tray 71 is returned to the initial position by the moving mechanism 18.

Moreover, in the present embodiment, a configuration is provided so that, when one job is executed for the medium P in a stage before the medium P is transported to and supported by the pair of medium supporting portions 50L and 50R, after one set of the media P, which corresponds to the one job, drops onto the stacking portion 37 from the pair of medium supporting portions 50L and 50R, the pair of medium supporting portions are arranged at the positions, at which the distance becomes the predetermined distance.

Here, for example, when recording is executed by the recording apparatus of ink jet or the like in the preceding stage, the "one job" denotes an instruction related to a recording mode that includes the number of sheets or the number of copies which is set in advance. When the recording based on the instruction is executed, a group of the one set of the media P, which corresponds to the one job, is generated. Moreover, when, for example, binding processing by using a staple or the like is executed in the preceding stage, the "one job" denotes an instruction related to a binding mode of the number of media P, a position of a staple, or the like, which is set in advance.

As to the group of the medium P, there may be a job by which one medium P constitutes the group, or there may be a job by which a plurality of sheets constitute the group. Furthermore, one set constituted by a plurality of media P may be the group, or a plurality of sets may be the group.

Operation of Embodiment 1 (FIGS. 4A and 4B)

As illustrated in FIG. 4A, in the present embodiment, a configuration is provided so that, when the width of the medium P stacked on the stacking portion 37 is equal to or more than a predetermined width, the pair of medium supporting portions 50L and 50R is arranged at positions at which a distance L1 between portions which are farthest in the width direction X becomes the predetermined distance which is less than the width of the medium P stacked on the stacking portion 37.

Here, the "predetermined width" in "when the width of the medium P is equal to or more than a predetermined width" is set in advance. Moreover, the "predetermined distance" in "arranged at positions at which a distance L1 between portions which are farthest in the width direction X becomes the predetermined distance which is less than the width of the medium P stacked on the stacking portion 37" is also set in advance from a viewpoint of facilitation of taking out the medium P.

With the aforementioned configuration, when the width of the medium P is wide, the pair of medium supporting portions 50L and 50R moves to positions at which open spaces 16 are provided in side portions of the medium P, that is, to an inner side of the width of the medium P. Thereby, it is possible to achieve a state where the medium P is easily removed in accordance with the width of the medium P.

As illustrated in FIG. 4B, in the present embodiment, a configuration is provided so that, when the width of the medium P stacked on the stacking portion 37 is less than the predetermined width, the pair of medium supporting portions 50L and 50R is arranged at positions at which a distance L2 between portions which are closest in the width direction X becomes the predetermined distance which is greater than the width of the medium P stacked on the stacking portion 37.

Here, the "predetermined width" in "when the width of the medium P is less than the predetermined width" is set in advance. Moreover, the "predetermined distance" in "arranged at positions at which a distance L2 between portions which are closest in the width direction X becomes the predetermined distance which is greater than the width of the medium P stacked on the stacking portion 37" is also set in advance from the viewpoint of facilitation of taking out the medium P.

With the aforementioned configuration, when the width of the medium P is narrow, the pair of medium supporting portions 50L and 50R moves to positions at which open spaces 17 are provided in the side portions of the medium P, that is, separate positions outward from the sides of the medium P. Thereby, it is possible to achieve the state where the medium P is easily removed in accordance with the width of the medium P.

Note that, since widths of the media P are various, structures of the pair of medium supporting portions 50L and 50R and members in a periphery thereof may be designed by taking various widths into account so that the open spaces 16 or 17 are able to be secured.

Effect of Embodiment 1

(1) According to the present embodiment, each of the pair of medium supporting portions 50L and 50R is movable in the width direction X and arrangeable at the position at which the distance in the width direction X becomes the predetermined distance after the medium P is dropped onto the stacking portion 37, and the predetermined distance varies in accordance with the width of the medium P stacked on the stacking portion 37. Thereby, in accordance with the width of the medium P to be stacked on the stacking portion 37, it is possible to move the pair of medium supporting portions 50L and 50R to the positions which facilitate taking out the medium P.

(2) Moreover, according to the present embodiment, the pair of medium supporting portions 50L and 50R is arranged at the positions, at which the distance becomes the predetermined distance, after one set of media P, which corresponds to one job, drops onto the stacking portion 37 from the pair of medium supporting portions 50L and 50R. Thereby, it is possible to move the pair of medium supporting portions 50L and 50R to the positions which facilitate removal of the medium P, in accordance with actual circumstances that the timing of removing the media P is set for each group in multiple cases.

Embodiment 2

Figure 5:
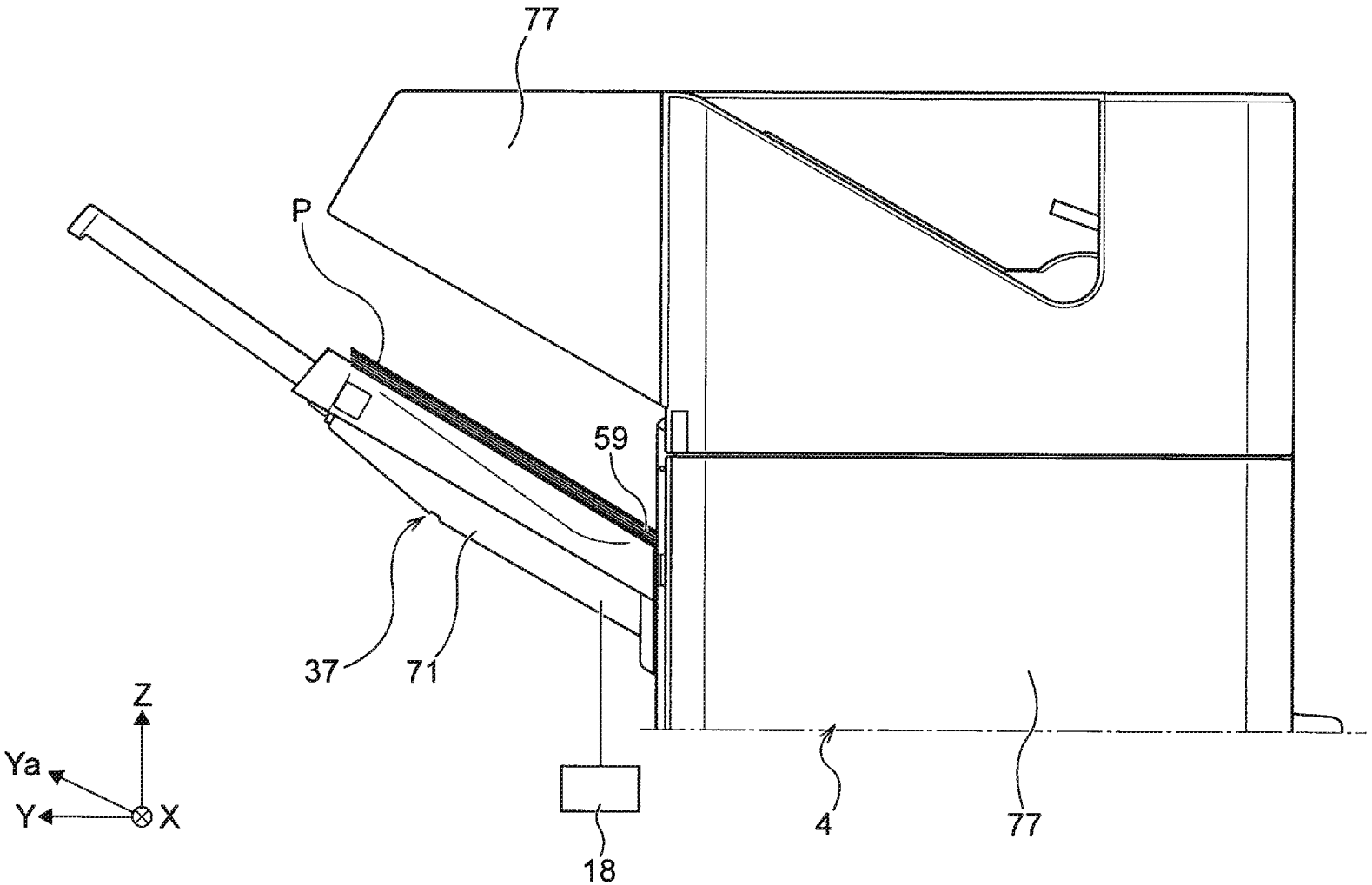
FIG. 5 is a front view illustrating a processing apparatus of Embodiment 2.

Hereinafter, Embodiment 2 of the disclosure will be described specifically with reference to FIGS. 5 and 6.

Note that, a structure of a discharging device according to Embodiment 2 is common to Embodiment 1 except for a part of a configuration. Then, description will be mainly given for a portion of the structure, which is different from that of Embodiment 1, and a common portion will be given the same reference sign and description thereof will be omitted.

In the present embodiment, the stacking portion 37 is able to be raised/lowered by the moving mechanism 18, and is able to be stopped between an upper limit position and a lower limit position when being raised/lowered. Here, the upper limit position is a position at which the stacking portion 37 receives the medium P that drops from the medium supporting portions 50 in a state where there is no medium P, that is, the initial position. The lower limit position is a lowered position which corresponds to a maximum stacking number of media. Specifically, a configuration is provided so that the discharge tray 71 is raised/lowered between the upper limit position and the lower limit position by the moving mechanism 18 and, furthermore, is able to be stopped at a position between the upper limit position and the lower limit position.

Moreover, in the present embodiment, the stacking portion 37 is configured to be movable to a removal position (position in FIG. 5) which is lower than a receiving position at which the medium P that drops from the pair of medium supporting portions 50L and 50R is received, that is, the initial position. In other words, a configuration is provided so that the discharge tray 71 is able to be moved to be lowered to the removal position by the moving mechanism 18 in a stage where the medium P is stacked on the stacking portion 37 and a stacking amount of the medium P reaches to a taking-out amount.

Here, the receiving position at which the medium P that drops from the pair of medium supporting portions 50L and 50R is received means the receiving position in a state where the medium P is stacked on the stacking portion 37. Since it is difficult to remove the medium P at the receiving position in this state, the stacking portion 37 is lowered from the receiving position to thereby provide an open space and facilitate taking out the medium P.

Note that, the movement of the stacking portion 37 to the removal position is not performed on the assumption that the pair of medium supporting portions 50L and 50R is arranged at the positions at which the distance becomes the predetermined distance. That is, the movement of the stacking portion 37 to the removal position may be executed in a state where the pair of medium supporting portions 50L and 50R is not arranged at the positions at which the distance becomes the predetermined distance.

Effect of Embodiment 2

(1) According to the present embodiment, the stacking portion 37 is able to be stopped by the moving mechanism 18 between the upper limit position and the lower limit position when being raised/lowered, so that, by lowering the stacking portion 37, it is possible to achieve the state where the medium P is easily removed.

(2) Moreover, according to the present embodiment, the stacking portion 37 is movable to the removal position which is lower than the receiving position at which the medium P that drops from the pair of medium supporting portions 50L and 50R is received. Thereby, when the stacking portion 37 is moved to the removal position, it is possible to provide the open space, so that it is possible to achieve the state where the medium P is easily removed. Structure for detecting that stacking portion is raised/lowered (FIG. 6).

Figure 6:
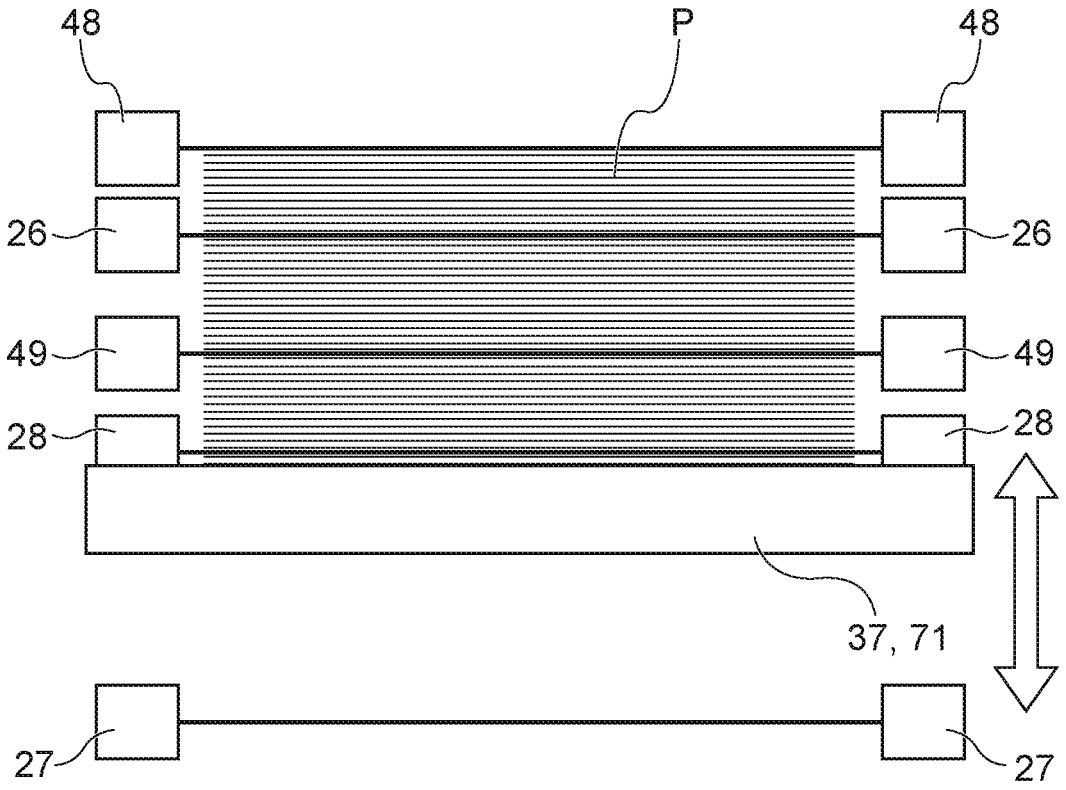
FIG. 6 is a view for explaining an operation of the processing apparatus of FIG. 5.

As illustrated in FIG. 6, in the present embodiment, above the stacking portion 37, a first medium sensor 48 that detects a height of the medium P stacked on the stacking portion 37, and a second medium sensor 49 that is positioned under the first medium sensor 48 are arranged. Each of the first medium sensor 48 and the second medium sensor 49 is a known optical sensor, and detects existence of the medium P when light is shielded. Note that, the first medium sensor 48 corresponds to the medium height sensor in Embodiment 1.

Furthermore, a first tray sensor 26 that detects an upper limit position of the discharge tray 71 of the stacking portion 37, which is raised/lowered, a second tray sensor 27 that detects a lower limit position, and a third tray sensor 28 that detects a stand-by position at which the discharge tray 71 is caused to stand by between the first tray sensor 26 and the second tray sensor 27 are arranged. The first tray sensor 26 is positioned between the first medium sensor 48 and the second medium sensor 49. The second medium sensor 49 is positioned between the first tray sensor 26 and the third tray sensor 28. Each of the tray sensors 26, 27, and 28 is a known lever-type sensor. Operation of detecting that stacking portion is raised/lowered.

1. By moving to the initial position before the dropping of the medium P starts, the discharge tray 71 shifts from a state of being at the stand-by position at which the discharge tray 71 is detected by the third tray sensor 28 to a state of receiving the dropping of the medium P. When the first tray sensor 26 detects the discharge tray 71 which is being raised, the discharge tray 71 is stopped at the initial position.

2. When a bundle of media P drops from the pair of medium supporting portions 50L and 50R in a state where the discharge tray 71 exists at the initial position, a height of the bundle of the media P is detected by the first medium sensor 48, and the discharge tray 71 is lowered downward in the vertical direction Z by an amount of a lamination height of the bundle of the media P, which has dropped, by the moving mechanism 18. The dropping of the media P and the lowering of the discharge tray 71 are repeated, and then a stacking amount of the media P increases. When timing of taking out the media P from the stacking portion 37 comes, the moving mechanism 18 lowers the discharge tray 71 to the removal position. The removal position is set in advance so as to lower the discharge tray 71 by a predetermined distance, by considering the aforementioned easiness of taking out the media P. Alternatively, the removal position may be matched with the stand-by position. In this case, when the third tray sensor 28 detects the discharge tray 71 which is being lowered, the discharge tray 71 is stopped at the stand-by position.

When the media P are removed from the stacking portion 37, the discharge tray 71 is raised to the initial position.

3. In a case where a job with which a large number of media P are stacked on the stacking portion 37 is executed, when the number of media P stacked on the stacking portion 37 reaches to the maximum number, the second tray sensor 27 detects the discharge tray 71. Thereby, lowering of the discharge tray 71 stops at this position. When the media P are removed from the stacking portion 37, the discharge tray 71 is raised to the stand-by position and stopped.

When the predetermined number of media P or more remain on the discharge tray 71 in this state, the second medium sensor 49 detects the remaining media P. Thereby, it is possible to grasp that the media P remain on the discharge tray 71, and take an action thereafter.

4. Moreover, in a case where the first medium sensor 48 detects existence of the media P when the discharge tray 71 is raised from the stand-by position to the initial position, it is possible to grasp this state and take an action thereafter.

Other Embodiments

The discharging device 30 according to the embodiments of the disclosure basically has the above-described configuration, but, needless to say, modification, omission, or the like of a part of the configuration is also allowed within a range not departing from the gist of the disclosure of the present application.

A configuration may be provided so that the timing at which the pair of medium supporting portions 50L and 50R is arranged at the positions at which the distance becomes the predetermined distance is able to be adjusted. Thereby, it is possible to move the pair of medium supporting portions 50L and 50R to the positions, at which the distance becomes the predetermined distance, only when the medium P stacked on the stacking portion 37 is removed, so that it is possible to prevent unnecessary movement from being performed.

In the recording system 1, the intermediate apparatus 3 may be omitted. In this case, each of the recording apparatus 2 and the processing apparatus 4 may be provided as an independent unit, or the recording apparatus 2 and the processing apparatus 4 may be integrated. Moreover, the recording apparatus 2 may be equipped with the discharging device 30.

What is claimed is:

1. A discharging device comprising:

a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, wherein each of the pair of medium supporting portions is configured to move in the width direction, the pair of medium supporting portions are arranged, after the medium is dropped onto the stacking portion, at positions at which a distance in the width direction becomes a predetermined distance, the pair of medium supporting portions does not overlap with sides of the medium in a vertical direction when the pair of medium supporting portions are arranged at the positions at which the distance in the width direction becomes the predetermined distance, and the predetermined distance varies in accordance with a width of the medium stacked on the stacking portion.

2. The discharging device according to claim 1, wherein when one job is executed for the medium in a stage before the medium is transported to the pair of medium supporting portions, after one set of medium, which corresponds to the one job, drops onto the stacking portion from the pair of medium supporting portions, the pair of medium supporting portions are arranged at the positions at which the distance becomes the predetermined distance.

3. The discharging device according to claim 1, wherein the stacking portion is configured to be raised/lowered by a moving mechanism and be stopped between an upper limit position and a lower limit position when being raised/lowered.

4. The discharging device according to claim 3, wherein the stacking portion is configured to move to a removal position that is lower than a receiving position at which the medium that drops from the pair of medium supporting portions is received.

5. The discharging device according to claim 1, wherein when the width of the medium stacked on the stacking portion is equal to or more than a predetermined width, the pair of medium supporting portions are arranged at positions at which a distance between portions which are farthest in the width direction becomes the predetermined distance which is less than the width of the medium stacked on the stacking portion.

6. The discharging device according to claim 1, wherein when the width of the medium stacked on the stacking portion is less than a predetermined width, the pair of medium supporting portions are arranged at positions at which a distance between portions which are closest in the width direction becomes the predetermined distance which is greater than the width of the medium stacked on the stacking portion.

7. A processing apparatus comprising:

a processing portion that performs processing of a medium; and the discharging device according to claim 1, which receives, by the medium supporting portions, the medium that passed through the processing portion.

8. A recording apparatus including a recording portion that performs recording on a medium and a discharging portion that discharges the medium on which the recording was performed by the recording portion; and the processing apparatus according to claim 7, including a medium leading portion that leads the medium discharged from the discharging portion, wherein the processing apparatus performs processing of the medium led from the medium leading portion by a processing portion.

9. A discharging device comprising:

a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, wherein each of the pair of medium supporting portions is configured to move in the width direction, the pair of medium supporting portions are arranged, after the medium is dropped onto the stacking portion, at positions at which a distance in the width direction becomes a predetermined distance, the predetermined distance varies in accordance with a width of the medium stacked on the stacking portion, and when the width of the medium stacked on the stacking portion is equal to or more than a predetermined width, the pair of medium supporting portions are arranged at positions at which a distance between portions which are farthest in the width direction becomes the predetermined distance which is less than the width of the medium stacked on the stacking portion.

10. The discharging device according to claim 9, wherein when the width of the medium stacked on the stacking portion is less than a predetermined width, the pair of medium supporting portions are arranged at positions at which a distance between portions which are closest in the width direction becomes the predetermined distance which is greater than the width of the medium stacked on the stacking portion.

11. A processing apparatus comprising:

a processing portion that performs processing of a medium; and the discharging device according to claim 9, which receives, by the medium supporting portions, the medium that passed through the processing portion.

12. A recording system comprising:

a recording apparatus including a recording portion that performs recording on a medium and a discharging portion that discharges the medium on which the recording was performed by the recording portion; and the processing apparatus according to claim 11, including a medium leading portion that leads the medium discharged from the discharging portion, wherein the processing apparatus performs processing of the medium led from the medium leading portion by a processing portion.

13. The discharging device according to claim 9, wherein the pair of medium supporting portions are configured to be arranged at the positions at which the distance becomes the predetermined distance at an arbitrary timing.

14. A discharging device comprising:

a pair of medium supporting portions that are provided so as to face each other in a width direction intersecting a transporting direction in which a medium is transported and that support the medium that is transported; and a stacking portion that is provided vertically below the pair of medium supporting portions and on which the medium that drops from the pair of medium supporting portions is stacked, wherein each of the pair of medium supporting portions is configured to move in the width direction, the pair of medium supporting portions are arranged, after the medium is dropped onto the stacking portion, at positions at which a distance in the width direction becomes a predetermined distance, the predetermined distance varies in accordance with a width of the medium stacked on the stacking portion, and when the width of the medium stacked on the stacking portion is less than a predetermined width, the pair of medium supporting portions are arranged at positions at which a distance between portions which are closest in the width direction becomes the predetermined distance which is greater than the width of the medium stacked on the stacking portion.

15. The discharging device according to claim 9, wherein when the width of the medium stacked on the stacking portion is less than a predetermined width, the pair of medium supporting portions are arranged at positions at which a distance between portions which are closest in the width direction becomes the predetermined distance which is greater than the width of the medium stacked on the stacking portion.

16. A processing apparatus comprising:

a processing portion that performs processing of a medium; and the discharging device according to claim 15, which receives, by the medium supporting portions, the medium that passed through the processing portion.

17. A recording system comprising:

a recording apparatus including a recording portion that performs recording on a medium and a discharging portion that discharges the medium on which the recording was performed by the recording portion; and the processing apparatus according to claim 16, including a medium leading portion that leads the medium discharged from the discharging portion, wherein the processing apparatus performs processing of the medium led from the medium leading portion by a processing portion.

18. The discharging device according to claim 15, wherein the pair of medium supporting portions are configured to be arranged at the positions at which the distance becomes the predetermined distance at an arbitrary timing.

* * * * *